US005771821A

United States Patent [19]

Zhuravsky et al.

[11] Patent Number: 5,771,821

[45] Date of Patent: Jun. 30, 1998

[54] METHOD OF TREATING PLASTIC WASTE

[75] Inventors: Gennady Ivanovich Zhuravsky; Valery Vladimirovich Mulyarchik; Vladimir Alexeevich Marchenko; Anatoly Vasilievich Kukharev; Leonid Mikhailovich Vinogradov; Anatoly Zhoresovich Grebenkov; Vladimir Nikolaevich Drozdov; Valery Grigorievich Konstantinov; Vitaly Ivanovich Stetsjurenko; Ivan Ivanovich Khomich; Valery Vladimirovich Chemetiev, all of Minsk, Belarus

[73] Assignees: Science-Technical and Product-innovative Center "Tokema"; Small State Enterprise "Ekores", both of Belarus

[21] Appl. No.: 553,287

[22] PCT Filed: Mar. 24, 1995

[86] PCT No.: PCT/BY95/00002

§ 371 Date: Nov. 27, 1995

§ 102(e) Date: Nov. 27, 1995

[87] PCT Pub. No.: WO95/26127

PCT Pub. Date: Oct. 5, 1995

[30] Foreign Application Priority Data

Mar. 25, 1994 [BY] Belarus ..... 1827-01

[51] Int. Cl.[6] ..... F23G 5/00

[52] U.S. Cl. ..... 110/346; 432/215; 110/245; 585/241; 585/648

[58] Field of Search ..... 110/236, 245, 110/229, 248, 306, 346, 348; 585/241, 648; 432/215

[56] References Cited

U.S. PATENT DOCUMENTS

| | | | |
|---|---|---|---|
| 2,585,984 | 2/1952 | Alexander et al. | 432/215 X |
| 2,647,041 | 7/1953 | Robinson | 432/215 X |
| 3,901,951 | 8/1975 | Nishizaki . | |
| 3,946,680 | 3/1976 | Laman . | |
| 4,069,107 | 1/1978 | Koppelman et al. | 432/215 X |
| 5,326,919 | 7/1994 | Paisley et al. . | |

FOREIGN PATENT DOCUMENTS

| | | |
|---|---|---|
| 1221440 | 7/1966 | Germany . |
| 3531514 | 4/1987 | Germany . |
| 3739137 | 6/1989 | Germany . |
| 1669934 | 8/1991 | U.S.S.R. . |

OTHER PUBLICATIONS

Alexeyev, G.M., Industrial Methods of Sanitary Cleaning of Cities, L. Stroyizdat, 1983, pp. 33, 7–8, 14–15.

G.A. Bystrov, Rendering Harmless and Utilization of the Waste in Plastics Processing, Leningrad, Chemie, 1982, p. 230.

I.P. Mukhlenov, General Chemical Technology, Part 1. Theoretical Priniciples of the Chemical Technology, Moscow Vysshaya Shkola, 1971, p. 164.

M. Shtarke, Utilization of the Industrial and Domestic Waste, L. Dep (Leningrad), 1978 pp. 148–157.

*Primary Examiner*—Henry A. Bennett
*Assistant Examiner*—Susanne C. Tinker
*Attorney, Agent, or Firm*—Ladas & Parry

[57] ABSTRACT

Technology for treating industrial and domestic waste which can be applied in the chemical industry as well as in the power generation sector as a way of using plastic and polymer waste. The method involves: melting down the plastic waste in an atomsphere of superheated steam and thermal destruction of the waste at a temperature of 400°–500° C. on a multi-layered inert material whose particles diminish in size, layer by layer in the direction of flow of the melt, from 3.83 to 0.12 mm; and the removal and condensation of the gaseous products.

3 Claims, 1 Drawing Sheet

METHOD OF TREATING PLASTIC WASTE

FIELD OF THE INVENTION

The present invention relates to treatment of industrial and domestic waste. It can be applied in the chemical industry, as well as in the power generation sector as a way of using plastic and polymer waste.

BACKGROUND OF THE INVENTION

A method of treating domestic waste by feeding the waste into a drying area, pyrolysis, and burning of the solid products of pyrolysis is known. Thermal decomposition of the organic part of the waste in the pyrolysis area is performed without access to oxygen, owing to the heat of ascending hot gases flowing from the burning area. The gaseous products of pyrolysis are directed into a burning chamber, and owing to the heat of their burning, the air being fed into the burning area is heated (G. M. Alexeyev, V. N. Petrov, P. V. Shpilfogel "Industrial Methods of Sanitary Cleaning of Cities"L. Stroyizdat, 1983, pp. 7–8).

The disadvantages of this method are:

1. Dilution of the pyrolysis products with the burning products.
2. Release of harmful substances into the environment.
3. Need to keep the oxygen concentration in the smoke gases to no more than 0.4% by volume.

A method for regeneration of polyurethane waste is known (SU inventor's certificate No. 1669934, 1991). According to this method, the polyurethane waste is subjected to interaction with a destructive agent in the presence of a catalyst at a temperature of 130°–180° C. for 30–150 minutes, and then is treated with steam at T=160°–180° C. for 90–180 minutes.

The disadvantages of this method are:

1. Need to use scarce and expensive catalysts.
2. A long period of the process.
3. Complexity of the technical realization of the process (technological operations of various durations in time and at various temperature levels).

A method of thermal decomposition (pyrolysis) of waste is known (G. M. Alexeyev, V. N. Petrov, P. V. Shpilfogel "Industrial Methods of Sanitary Cleaning of Cities" L. Stroyizdat, 1983, pp. 14–15).

According to the method, waste in mixture with coal is fed into a reactor, a heat carrier (steam and air mixture) is blown into the lower part of the reactor, and the heat carrier is heated up to T=1500° C., by the burning of the coal. The heat carrier is then fed by contraflow to the waste which is moving from the top to the bottom of the reactor under the influence of its own weight. The gaseous products are removed from the reactor and cooled.

The disadvantages of this method are:

1. Release of harmful gaseous products into the environment.
2. High power-consumption of the process owing to the need to heat the heat carrier (steam and air mixture) up to T=1500° C.
3. High explosiveness of the gaseous products of decomposition owing to a high content of oxygen in them (the content of oxygen reaches 20% by volume).

The closest to the present invention is a method of treating plastic waste mixture which is taken as a prototype (G. A. Bystrov, V. M. Galperin, B. P. Titov "Rendering Harmless and Utilization of Waste in the Production of Plastics Processing" L. Chemie, 1982, p.230). Waste is melted down by means of a hot gas flow. The melt is subjected to thermal destruction in a boiling layer of a material having a high dispersity at a temperature of 400°–500° C. The forming gases are cooled and isolated in the form of liquid and gaseous products.

The disadvantages of this method are:

1. Release of harmful gaseous products into the environment.
2. High power-consumption of the process.
3. High explosiveness of the gaseous products of decomposition owing to a high content of oxygen in them (a content of oxygen reaches 20% by volume).

SUMMARY OF THE INVENTION

Problems solved by the present invention are the reduction of the amount of harmful products released into the environment and reduction of power-consumption of the process for treating plastic waste.

The claimed method involves melting down the plastic waste in an atmosphere of superheated steam, its thermal destruction at a temperature of 400°–500° C. in a multi-layered inert dispersing material, whose particles diminish in size, layer by layer from 3.83 mm to 0.12 mm in the direction of flow of the melt, and removal the gaseous products by condensation.

According to the invention, the plastic waste is treated in the following way.

The plastic waste is fed into a reactor 1 through a sluice hatch 2. The plastic waste may contain for example, polyethylene, polypropylene and/or polystyrene. At the same time from a steam-generator 3 through a steam-superheater 4 and a tap 6 into the lower part of the reactor 1 superheated steam is fed. The temperature of the steam is controlled between T=400° to 500° C. be means of the temperature measuring instrument 5 readings. Further from the lower part of the reactor 1, when manipulating the tap 6 (i.e. turning the tap 6 in the direction of the increase of the through section of the tap), superheated steam is passed through the layer of an insert dispersing material 7 (sand, chamotte, fine pebbles etc.). The steam filtering through the layer of material 7 heats it up to T=400°–500° C. The temperature of material heating is controlled by means of the temperature measuring instrument 9 readings. The material heating rate is determined by the amount of steam expanse, and the mass and thermophysical characteristics of the material. After filtration through the layer of the dispersing material steam passes through plastic waste 8 which is fed through the hatch 2 to the surface of the material layer, and enters the outlet of the reactor. The steam pressure in the reactor is controlled by means of the manometer 10 readings. When contacting with superheated steam and dispersing material, the waste is heated and melted down. The melt under the influence of the force of gravity impregnates the dispersing material, envelops the material particles, as a result a large specific surface of the divide "melt-steam" forms. The process of heat transfer from the superheated steam flow to the melt is sharply intensified. Under action of the heat thermal decomposition of the waste, formation of gaseous products occurs. The gaseous products of decomposition are mixed with the steam flow, and carried by it to the outlet of the reactor 1.

The mixture of the gaseous products of decomposition and steam from the reactor 1 finds itself in a refrigerator 11, wherein the mixture is cooled up to T=0°–100° C. by means of heat exchange for example with running water. The temperature of cooling is controlled by means of the temperature measuring instrument 12 readings. As a result of the cooling of the steam and gas mixture a condensate forms (steam condenses), and non-condensing gas remains. Non-condensing gas by means of a pump 13 is pumped into a gas collector 14 (gas-holder). The condensate is fed through the tab 15 into the steam-generator 3 for production of steam.

An overfall of pressure arising during filtration of steam through the particle layer prevents penetration of melted plastic into the layer. The force under that penetration of melted plastic into the particle layer is the force of weight of the melt ρ Жg. If the force of weight of the melt exceeds the overfall of pressure ρ Жg>ΔP/L, penetration of the melt into the particle layer is going on, otherwise carrying-out of the melt from the layer with steam flow takes place. A balance (the melt is not carried out from the layer and not penetrated further into the layer) is observed in the case of a force equality, i.e. ΔP/L=ρ Жg, where ρ Ж is a melt density, kg/cm; g is an acceleration of gravity, m/sq.sec, and ΔP is an overfall of pressure.

In this case the plastic waste charged into the chamber is collected over the surface in the form of the melt (it melts owing to the heat which is transferred from the steam flow). Since composition of the waste consists of polypropylene (density ρpp=920–930 kg/cm), polystyrene (density ρps=1050 kg/cm), polyethylene (density ρpe=920–960 kg/cm) ("Encyclopedia of Polymers", V3.M.: "Soviet Encyclopedia", 1972, p. 211, 534, 1005), the melt will exfoliate by density, i.e. underneath will be a melted polymer having a higher density, for example melted polystyrene, and above will be a melted polymer having a lower density, for example melted polypropylene. Thus at first into a porous medium will penetrate a melted polymer of the highest density. This melt will penetrate into the porous medium (a particle layer) unless its weight ρ Жg becomes balanced with the overfall of pressure ΔP/L, i.e. $(P_2-P_1)/L$, where $P_2$ is a steam pressure at the entrance into the layer, $P_1$ is a pressure at the distance of L from the entrance into the layer where the melt has penetrated.

Steam on leaving the porous medium diffuses through the melt to the outlet from the chamber (reactor). The highest possible speed of diffusion of steam through the melt is 0.7 m/sec (I. P. Mukhlenov, A.Ya. Averbukh, et al. *General Chemical Technology*, part 1, Theoretical Principles of Chemical Technology, M. Vysshaya Shkola, 1971, p. 164). At the higher speed a foam layer forms, i.e. the melt foams, that prevents the melt from penetrating into the particle layer and disturbs the uniformity of the melt.

Tables 1 to 4 show experimental data for diameters of the particles, in the layer of which of the given porosity (maximum and minimum possible) melt of the certain porosity is delayed.

TABLE 1

| No | Particle diameter dy,mm | Density of polymerρ * kg/cm | Density of steam $\rho_p$ kg/cm | Viscosity of steam, $\mu_p$ N°s/sq · m | Porosity ϵ |
|---|---|---|---|---|---|
| 1 | 3.69 | 920 | 0.32 | $243 \cdot 10^{-7}$ | 0.2595 |
| 2 | 3.41 | 1050 | 0.32 | $243 \cdot 10^{-7}$ | 0.2595 |
| 3 | 3.26 | 1130 | 0.32 | $243 \cdot 10^{-7}$ | 0.2595 |
| 4 | 3.19 | 1170 | 0.32 | $243 \cdot 10^{-7}$ | 0.2595 |

TABLE 1-continued

| No | Particle diameter dy,mm | Density of polymerρ * kg/cm | Density of steam $\rho_p$ kg/cm | Viscosity of steam, $\mu_p$ N°s/sq · m | Porosity ϵ |
|---|---|---|---|---|---|
| 5 | 3.00 | 1300 | 0.32 | $243 \cdot 10^{-7}$ | 0.2595 |
| 6 | 2.95 | 1350 | 0.32 | $243 \cdot 10^{-7}$ | 0.2595 |
| 7 | 2.84 | 1430 | 0.32 | $243 \cdot 10^{-7}$ | 0.2595 |
| 8 | 2.66 | 1600 | 0.32 | $243 \cdot 10^{-7}$ | 0.2595 |
| 9 | 2.21 | 2200 | 0.32 | $243 \cdot 10^{-7}$ | 0.2595 |

TABLE 2

| No | Particle diameter dy,mm | Density of polymerρ * kg/cm | Density of steam $\rho_p$ kg/cm | Viscosity of steam $\mu_p$ N°s/sq · m | Porosity ϵ |
|---|---|---|---|---|---|
| 1 | 3.83 | 920 | 0.28 | $284 \cdot 10^{-7}$ | 0.2595 |
| 2 | 3.55 | 1050 | 0.28 | $284 \cdot 10^{-7}$ | 0.2595 |
| 3 | 3.40 | 1130 | 0.28 | $284 \cdot 10^{-7}$ | 0.2595 |
| 4 | 3.33 | 1170 | 0.28 | $284 \cdot 10^{-7}$ | 0.2595 |
| 5 | 3.22 | 1300 | 0.28 | $284 \cdot 10^{-7}$ | 0.2595 |
| 6 | 3.07 | 1350 | 0.28 | $284 \cdot 10^{-7}$ | 0.2595 |
| 7 | 2.97 | 1430 | 0.28 | $284 \cdot 10^{-7}$ | 0.2595 |
| 8 | 2.79 | 1600 | 0.28 | $284 \cdot 10^{-7}$ | 0.2595 |
| 9 | 2.22 | 2200 | 0.28 | $284 \cdot 10^{-7}$ | 0.2595 |

TABLE 3

| No | Particle diameter dy,mm | Density of polymerρ * kg/cm | Density of steam $\rho_p$ kg/cm | Viscosity of steam $\mu_p$ N°s/sq · m | Porosity ϵ |
|---|---|---|---|---|---|
| 1 | 0.189 | 920 | 0.32 | $243 \cdot 10^{-7}$ | 0.77 |
| 2 | 0.176 | 1050 | 0.32 | $243 \cdot 10^{-7}$ | 0.77 |
| 3 | 0.170 | 1130 | 0.32 | $243 \cdot 10^{-7}$ | 0.77 |
| 4 | 0.167 | 1170 | 0.32 | $243 \cdot 10^{-7}$ | 0.77 |
| 5 | 0.158 | 1300 | 0.32 | $243 \cdot 10^{-7}$ | 0.77 |
| 6 | 0.155 | 1350 | 0.32 | $243 \cdot 10^{-7}$ | 0.77 |
| 7 | 0.150 | 1430 | 0.32 | $243 \cdot 10^{-7}$ | 0.77 |
| 8 | 0.142 | 1600 | 0.32 | $243 \cdot 10^{-7}$ | 0.77 |
| 9 | 0.120 | 2200 | 0.32 | $243 \cdot 10^{-7}$ | 0.77 |

TABLE 4

| No | Particle diameter dy,mm | Density of polymerρ * kg/cm | Density of steam $\rho_p$ kg/cm | Viscosity of steam $\mu_p$ N°s/sq · m | Porosity ϵ |
|---|---|---|---|---|---|
| 1 | 0.202 | 920 | 0.28 | $284 \cdot 10^{-7}$ | 0.77 |
| 2 | 0.189 | 1050 | 0.28 | $284 \cdot 10^{-7}$ | 0.77 |
| 3 | 0.182 | 1130 | 0.28 | $284 \cdot 10^{-7}$ | 0.77 |
| 4 | 0.179 | 1170 | 0.28 | $284 \cdot 10^{-7}$ | 0.77 |
| 5 | 0.169 | 1300 | 0.28 | $284 \cdot 10^{-7}$ | 0.77 |
| 6 | 0.167 | 1350 | 0.28 | $284 \cdot 10^{-7}$ | 0.77 |
| 7 | 0.161 | 1430 | 0.28 | $284 \cdot 10^{-7}$ | 0.77 |
| 8 | 0.152 | 1600 | 0.28 | $284 \cdot 10^{-7}$ | 0.77 |
| 9 | 0.130 | 2200 | 0.28 | $284 \cdot 10^{-7}$ | 0.77 |

Experimental data given in Tables 1 to 4 show that the particle diameter d Pchanges within the limits of 0.120 to 3.83 mm. As is known (Encyclopedia of Polymers, M.: Soviet Encyclopedia, 1972, V. 2,3.1), density of plastics change within the limits of 920 to 2200 kg/cm.

Thus it is necessary to form the layer of the inert material in the chamber from particles of diameter d P=0.120 to 3.83 mm. By this distribution of the particles by height of the layer (depending on the particle diameter) is established so that underneath are the particles of the minimum diameter (d Ꝑ=0.120 mm), and above are the particles of the maximum diameter (d Ꝑ=3.83 mm), i.e. the layer is formed starting with the particles of the smallest diameter (ones of the minimum diameter of 0.120 mm are first charged into the chamber), and the particles of the largest diameter (ones of the largest diameter of 3.83 mm are charged into the chamber last.

Since the melted plastic waste can contain ingredients of density ρ Ж=920–2200 kg/cm, in the layer of inert dispersing material division of melted plastic by the ingredients will occur. The ingredients of melted plastic of the highest density ρ Ж=2200 kg/cm will penetrate the deepest into the layer of the particles and remain underneath on the particles of d Ꝑ=0.120 mm. The ingredients of the lowest density ρ Ж=920 kg/cm will remain above on particles of d Ꝑ=3.69 mm. Between these ingredients in the layer of inert dispersing material will disperse (by the height of the layer) the rest of the ingredients, a number of which can be different and is determined by the initial composition of the plastic waste.

Owing to division of the melt by ingredients by the height of the layer, a process of thermal destruction of polymers is intensified. This is conditioned by the following circumstances. As is known, polymers of higher density have the higher temperature of beginning of the melt process, for example polyethylene (ρ Ж=920 kg/cm) has a temperature of destruction of $T_d$=290° C., kapron (ρ Ж=1150 kg/cm) has a $T_d$=300° C., fluoroplastics (ρ Ж=2200 kg/cm) have $T_d$=400° C. At the same time during the filtration of the heat carrier through the layer of a dispersing material at the initial moment (before uniform warming-up of the whole of the layer) a gradient of temperatures is established. At the entrance into the layer the temperature is at a maximum, and at the outlet from the layer the temperature is at a minimum. Therefore to provide the optimum conditions for thermal destruction of polymers it is necessary that the polymers having the higher melting temperature be fed into the lower part of the layer, and the polymers having the lower melting temperature be fed into the upper part of the layer. The last is reached by using the layer of an inert dispersing material whose particles have a diameter of d Ꝑ=0.12–3.83 mm.

In the case of using particles of a diameter more than, for example, d Ꝑ=3.83 mm, all the melted plastic will penetrate through the inert layer and find itself in a high temperature area, where under influence of high temperature the ingredients having the lower temperature of destruction form a solid phase (are coked), which creates a structure impenetrable for the heat carrier, as a result feeding of the heat carrier into the chamber ends, and the process breaks.

Using particles of smaller diameter, for example, less than d Ꝑ=0.12 mm will not permit the melt of even the highest density to penetrate into the layer. In addition, using particles of d Ꝑ=0.12 mm results in a sharp increase of layer resistance, and thereby decreases an expanse of the pumped carrier, that results in a drop in plant productivity. It is known that thermal decomposition of the most steady polymer (fluoroplastics) proceeds at a temperature T=400° C. Practically at the same temperature the other polymers decompose completely too (G. M. Alexeyev, P. V. Shpilfogel, Industrial Methods of Sanitary Cleaning of Cities. L.: Stzoyizdat, 1983, p. 32–33).

Thus for realization of complete decomposition of the plastic waste which contains, as a rule, polyethylene, polypropylene, polystyrene, fluoroplastics, it is necessary to heat it up to T=400° C. and higher.

The maximum temperature of superheated steam must not exceed 500° C., since at the temperatures T>500° C. a process of decomposition of hydrocarbons into elements ($H_2$ and C) is sharply intensified, as a result carbon falls out on the particles of the dispersing material, and this results in-blocking-up the layer of the material with carbon (soot).

Steam and gas mixture (the gaseous products of decomposition and steam) on leaving the reactor are cooled in the condenser (refrigerator). Of course, the higher temperature of the mixing feeding into the condenser, the more energy is necessary to cool the mixture to T=0°–100° C., and therefore more heat carrier is necessary to pump through the refrigerator. This results in an increase of the power necessary for the cooling process (see Table 5).

TABLE 5

| Mixture temperature, °C. | Amount of energy taking aside in the refrigerator, kJ/kg |
|---|---|
| 500 | 1490 |
| 510 | 1850 |
| 520 | 2138 |
| 530 | 2340 |

Thus it is inexpedient to raise the temperature of the superheated steam higher than 500° C., since it results in an increase of the power needed and disturbs the process. The gaseous products in mixture with steam are cooled in the refrigerator in order to condense the steam. Since at atmospheric pressure steam is condensed at a temperature of 100° C., the mixture must be cooled to 100° C. or lower. The lower the temperature of cooling, the greater amount of steam that will be condensed, and the higher will be percentage content of gas in the mixture at the outlet from the refrigerator. However, it is permissible to cool the mixture up to T=0° C., since at temperatures lower than T=0° C. the condensate (water) flowing out of the condenser will be frozen, forming ice that will block up the condenser.

Variants of Realization of the Invention

Figure 1:
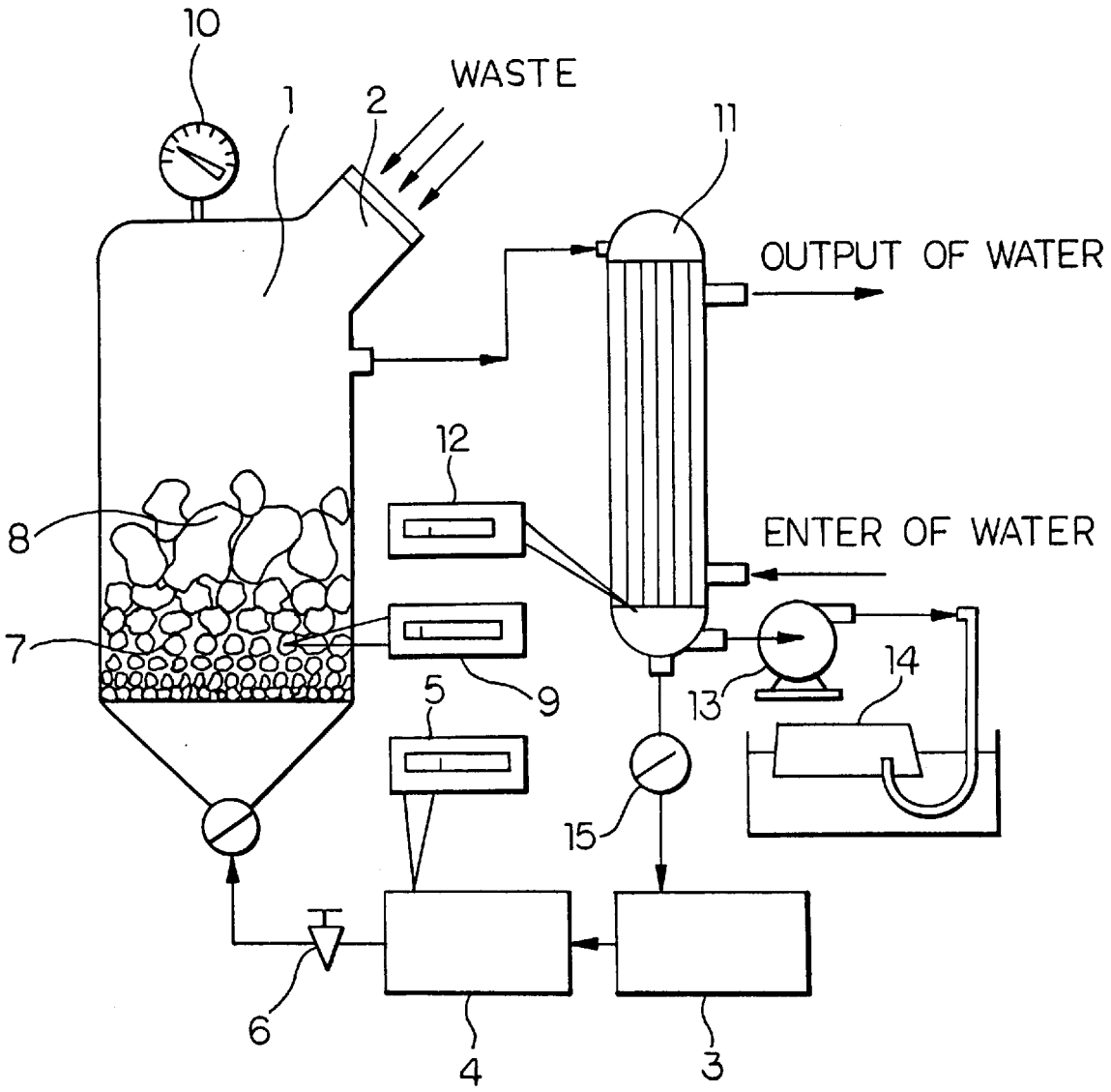
FIG. 1 shows a general view of the device for realization of the method of plastic waste processing.

The invention is illustrated by the following examples.

EXAMPLE 1

Into the reactor 1 through the sluice hatch 2 is fed plastic waste containing polyethylene, polystyrene and fluoroplastics at a rate of 150 kg/hour (50 kg of polyethylene, 50 kg of polystyrene, 50 kg of fluoroplastics). At the same time from the steam generator 3 through the steam-superheater 4, when controlling temperature of steam by means of the temperature measuring instrument 5 readings, through the tap 6 into the lower part of the reactor 1 is fed steam superheated up to T=400° C. Further from the lower part of the reactor 1, when turning the tap 6 in the direction of increase of through section of the tap, the superheated steam is passed through the layer of an inert dispersing material 7 which contains the particles of diameter d Ꝑ=0.12–3.83 mm. The particles in the layer are laid in such a way that underneath are the particles of d Ꝑ=0.12 mm, and above is the layer of particles of d Ꝑ=3.83 mm. For creation of these layers quartz sand particles dispersing by fractions are used. First into the chamber on the grating a layer of particles of diameter d P=0.12 mm is poured, on this layer a layer of particles of diameter d P=0.13 mm is poured, further particles of diameter d P=0.176, d P=0.189, d P=0.202, d P=2.21, d P=2.33, d P=3.41, d P=3.55, d P=3.69, d P=3.83 mm are respectively poured (see Tables 1 to 4). Assume that the height of each layer is 5 cm. Thus the total height of sand in the chamber will be 55 cm (5 cm by 11 layers). Mean porosity of the sand layer $\epsilon$=0.2595. Assume that the diameter of the chamber is 0.2 m. A mass of the poured sand will be:

$$M_{quartz}=\rho_{quartz}\cdot V_{quartz}=1500\ \text{kg/c.m}\cdot 3.14\cdot(0.2/2)^2\cdot 0.55\ \text{mm}\approx 26\ \text{kg}$$

Super-heated steam is passed through a layer of inert material, passes through plastic waste 8 and the outlet of the reactor. The waste is heated and melted down. First the waste having the lowest temperature of melting is melted down. In this case first polystyrene is melted down (T of melting is about 105° C.), then polyethylene is melted down (T of melting is about 135° C.) and in the end fluoroplastics are melted down (T of melting is about 220° C.).

Melted polystyrene flows into the layer of sand to a level where the particles of diameter d P=3.41 mm are, i.e. 15 cm deep. Melted polyethylene penetrates into the layer of inert material and is delayed on the particles of d P=3.69 mm, and melted fluoroplastics penetrate into the layer of sand to a level where the particles of d P=2.21 mm are, i.e. 25 cm deep. Thus division of the melt in the ingredients which disperse in the layer of sand by its height is going on. Superheated steam heats sand and melted plastic up to temperature T=400° C., as a result thermal destruction of plastics occurs with formation of gaseous products. By this the temperature of heating is observed by means of the temperature measuring instrument 9 readings.

Steam in the mixture with the gaseous products of waste destruction is fed at the outlet from the reactor. The pressure of the steam and gas mixture in the reactor is observed by means of the manometer 10 readings. The mixture of the gaseous products of decomposition and steam is fed into the refrigerator 11, where it is cooled to a temperature T=100° C. by heat exchange. The temperature of cooling is controlled by means of the temperature measuring instrument 12 readings. Following cooling of the steam and gas mixture a condensate forms (steam and styrene are condensed) and a non-condensing gas is formed. Non-condensing gas is pumped into the gas collector (gas-holder) 14 by means of the pump 13. Condensate through the tap 15 is fed into the steam-generator 3. In the accumulating volume of the steam-generator 3 styrene is separated (styrene comes to the surface of condensate and is easily separated), and water is fed into the boiler of the steam-generator for production of steam.

EXAMPLE 2

Into the reactor 1 through the sluice hatch 2 is fed the plastic waste containing polyethylene, polypropylene and fluoroplastics at a rate of 120 kg/hour (40 kg of polyethylene, 40 kg of polypropylene, 40 kg of fluoroplastics). At the same time from the steam-generator 3 through the steam superheater 4, when controlling temperature of steam by means of the temperature measuring instrument 5 readings, through the tap 6 into the lower part of the generator 1 steam superheated to T=500° C. is fed. Further from the lower part of the reactor 1, when turning the tap 6 in the direction of increase of through section of the tap, superheated steam is passed through the layer of inert dispersing material 7 which contains particles of d P=0.12 mm particles of d P=3.83 mm.

For creation of these layers quartz particles dispersed by fractions are used. At first into the chamber on the grating a layer of d P=0.12 mm is poured. On this layer a layer of the particles of d P=0.13 mm is poured, then particles of d P=0.189, d P=0.202, d P=2.21, d P=2.33, d P=3.69, d P=3.83 mm respectively are poured (see Tables 1 to 4). Assume that the height of each layer is 10 cm. Thus the height of the quartz particle layers in the chamber will form a value of 80 cm (10 cm by 8 layers). Such a set of the particles is conditioned in the given example by that density of polyethylene ρpp=920 kg/cm, and density of polypropylene ρpp=920 kg/cm. Assume that the diameter of the chamber is 0.2 m. A mass of quartz poured into the chamber will be:

$$M_{quartz}=\rho_{quartz}\cdot V_{quartz}=40.2\ \text{kg}$$

Superheated steam is filtered through the plastic waste 8 and to the outlet of the reactor. The waste is heated and melted down. At first polyethylene is melted down (T of melting is 135° C.), then polypropylene is melted down (T of melting is 172° C.), and fluoroplastics are metled down in the last place (T of melting is 220° C.). The melted polyethylene and melted polypropylene (ρpe=ρps are delayed on the particles d P=3.83 mm, i.e. on the surface of the layer. The melted fluoroplastics are delayed on the particles of d P=2.33 mm, i.e. penetrate into the layer 20 cm deep. Thus division of the melt in the ingredients occurs which disperse in the layer of sand by its height. Super-heated steam heats the layer of sand and melted plastic up to T=500° C., following thermal destruction of plastic with formation of the gaseous products. The temperature of heating is observed by means of the temperature measuring instrument 9 readings. For heating of 120 kg of the plastic waste and 40.2 kg of quartz to T=500° C. the following amount of the superheated steam is needed:

$$M_{steam}=\frac{(C_p^{ns}\cdot M_{ns}+C_p^{nn}\cdot M_{nn}+C_p^{\phi}\cdot M_{\phi}+C_p^{KB}\cdot M_{KB})\cdot\Delta T}{C_p^{n}\cdot\Delta T^{n}}=139.7\ \text{kg}$$

where $C_p^{ns}$, $C_p^{nn}$, $C_p^{\Phi}$—a specific heat of polyethylene, polypropylene and fluoroplastics;

$C_p^{KB}$—a specific heat of quartz;

$M_{nn}$, $M_{ns}$, $M_{\phi}$, $M_{KB}$,—a mass of polyethylene, polypropylene, fluoroplastics and quartz, relatively;

$C_p^{n}$—a thermal heat of steam;

ΔT—a difference of temperatures.

Steam in mixture with the gaseous products of waste destruction is fed at the outlet from the reactor. The pressure of the steam and gas mixture in the reactor is observed by means of the manometer 10 readings. The mixture of the gaseous products of decomposition and steam is fed into the refrigerator 11, where it is cooled to a temperature of T=0° C. by heat exchange. The temperature of cooling is controlled by means of the temperature measuring instrument 12 readings. Following cooling of steam and gas mixture a condensate forms (steam is condensed), and non-condensing gas remains. Non-condensing gas is pumped into the gas-holder 14 by means of the pump 13. Condensate through the tap 15 is fed into the steam-generator 3 for production of steam.

Industrial Applicability

The claimed method of treating plastic waste reduces the amount of unhealthy discharge in the environment, since all the gaseous and liquid products are utilized in the process (the condensate is used for production of steam, and gas can be used as a raw material for production of plastics). Power-consumption for treating the plastic waste according to this method is reduced owing to use of a part of the provided gas (15–20%) in the fire-chamber of the steam-generator for production of steam, so that the need to use other energy resources (natural gas, mazut, solid fuel) to treat plastics waste is reduced.

The claimed process has vast industrial potential owing to the following considerations:

1. Possibility of picking-out steam from the steam and gas mixture by condensation permits concentration of the products of decomposition without particular technical complexity and to carry their content by volume practically to 100%.

2. Possibility of treating plastics according to the given method, when the products of decomposition include hydrogen chloride and sulphur containing compounds.

3. Simplicity of the heat carrier recirculation.

4. Particular characteristics of process of plastics decomposition in an atmosphere of steam that permits the melt products to be used as a raw materials in production of plastics.

5. High economy of the process reached both owing to the heat carrier recirculation, and owing to possibility of obtaining valuable chemical raw materials from a waste.

6. Absence of unhealthy discharge into the environment, since unhealthy materials are dissolved in condensate and can be easily rendered harmless in a solution.

7. Lower risk of fire and explosion of the process owing to use of steam.

We claim:

1. A method of treating plastic waste comprising heating the plastic waste with superheated steam at a temperature of 400° C. to 500° C. in a multi-layered insert dispersing material wherein within said multi-layered insert dispersing material are layers of particles of diminishing size, wherein the particles of a first layer have a diameter of about 3.83 mm and the particles of a last layer having a diameter of about 0.12 mm, wherein the direction of flow of the heated plastic is from the first layer to the last layer; and removing gaseous products.

2. The method of claim 1 wherein the superheated steam heats the inert dispersing material to a temperature of 400° C. to 500° C.

3. The method of claim 1 wherein the gaseous products are condensed.

* * * * *